US011299320B2

(12) United States Patent
Tornel

(10) Patent No.: US 11,299,320 B2
(45) Date of Patent: Apr. 12, 2022

(54) LOADING PALLET HAVING A SUPPORT FRAME AND INTERCHANGEABLE DECK

(71) Applicant: Gerardo Tornel, Tlajomulco de Zuñiga (MX)

(72) Inventor: Gerardo Tornel, Tlajomulco de Zuñiga (MX)

( * ) Notice: Subject to any disclaimer, the term of this patent is extended or adjusted under 35 U.S.C. 154(b) by 0 days.

(21) Appl. No.: 16/979,786

(22) PCT Filed: Mar. 15, 2018

(86) PCT No.: PCT/MX2018/000021

§ 371 (c)(1),
(2) Date: Jan. 27, 2021

(87) PCT Pub. No.: WO2019/177441

PCT Pub. Date: Sep. 19, 2019

(65) Prior Publication Data

US 2021/0163177 A1 Jun. 3, 2021

(51) Int. Cl.
*B65D 19/00* (2006.01)
*B65D 19/38* (2006.01)

(52) U.S. Cl.
CPC ..... *B65D 19/0095* (2013.01); *B65D 19/38* (2013.01); *B65D 2519/00029* (2013.01); *B65D 2519/00064* (2013.01); *B65D 2519/00099* (2013.01); *B65D 2519/00273* (2013.01); *B65D 2519/00293* (2013.01); *B65D 2519/00298* (2013.01); *B65D 2519/00323* (2013.01);
(Continued)

(58) Field of Classification Search
CPC ..... B65D 19/0095; B65D 19/38; B65D 2519/00029; B65D 2519/00064; B65D 2519/00099; B65D 2519/00273; B65D 2519/00293; B65D 2519/00298; B65D 2519/00323; B65D 2519/00333; B65D 2519/00373
USPC ..... 108/51.11, 56.3, 51.3, 57.21
See application file for complete search history.

(56) References Cited

U.S. PATENT DOCUMENTS 2,925,947 A * 2/1960 Brown ..... B65D 19/0012 206/596
3,204,583 A * 9/1965 Nicholson ..... B65D 19/0091 108/51.11

(Continued)

FOREIGN PATENT DOCUMENTS

GB 2273695 A * 6/1994 ..... B65D 19/0069
WO WO-2006014857 A1 * 2/2006 ..... B65D 19/0012

(Continued)

*Primary Examiner* — Jose V Chen
(74) *Attorney, Agent, or Firm* — Steve O'Donnell

(57) ABSTRACT

The present invention describes a pallet for cargo with a frame support and interchangeable cover that can have removable covers, which is easy to change, said cover can be of varied shapes and designs, for example, inclined crossbars, with circular reliefs to place buckets and that these do not move, with reliefs in the shape of parallelograms, to place boxes of various sizes and/or the combination of the above; Another characteristic of the pallet that is the reason for the present invention is that the upper deck can have a non-slip material to increase its coefficient of friction, making it possible to ensure that the material that is placed on the pallet for load with frame support and interchangeable cover, does not move during the transfer.

1 Claim, 12 Drawing Sheets

(52) U.S. Cl.
CPC ..... *B65D 2519/00333* (2013.01); *B65D 2519/00373* (2013.01)

(56) References Cited

U.S. PATENT DOCUMENTS 5,197,396 A * 3/1993 Breezer ..... B65D 19/0012 108/56.1
5,458,069 A * 10/1995 Stolzman ..... B29C 65/561 108/56.3
5,701,827 A * 12/1997 Urabe ..... B65D 19/0012 108/180
5,960,721 A * 10/1999 Huetteman ..... B65D 19/0095 108/57.17
10,000,311 B1 * 6/2018 Oliver ..... B65D 19/0095
10,005,586 B1 * 6/2018 Miller ..... B65D 19/0095
10,549,885 B2 * 2/2020 de Bokx ..... B65D 19/44
2003/0075081 A1 * 4/2003 Apps ..... B65D 19/0012 108/56.3
2004/0173483 A1 * 9/2004 Sutt, Jr. ..... B65D 19/0095 206/338
2004/0187745 A1 * 9/2004 Rojas ..... B65D 19/0095 108/51.11
2006/0005746 A1 * 1/2006 Gouldin, Jr. ..... B65D 19/0091 108/51.11
2006/0032413 A1 * 2/2006 Ogburn ..... B65D 19/0012 108/57.25
2006/0169185 A1 * 8/2006 Williams, Jr. ..... B65D 19/0095 108/56.3
2007/0234933 A1 * 10/2007 Donnell, Jr. ..... B65D 19/0016 108/56.3
2008/0141912 A1 * 6/2008 Valentinsson ..... B65D 19/0014 108/57.33
2008/0210140 A1 * 9/2008 Valentinsson ..... B65D 19/0014 108/57.25
2010/0229764 A1 * 9/2010 Ingham ..... B65D 19/0095 108/51.3
2012/0132114 A1 * 5/2012 Krupka ..... B65D 19/0095 108/57.25
2012/0260832 A1 * 10/2012 Linares ..... B65D 19/0095 108/51.3
2012/0325125 A1 * 12/2012 Apps ..... B65D 19/0014 108/57.25
2014/0000494 A1 * 1/2014 Gysin ..... B65D 19/0006 108/56.3
2018/0215505 A1 * 8/2018 Hawley ..... B65D 19/0095
2020/0031524 A1 * 1/2020 Lantz ..... B65D 19/0073
2020/0087028 A1 * 3/2020 Hawley ..... B65D 19/0095
2020/0283193 A1 * 9/2020 De Laender ..... B05D 7/08

FOREIGN PATENT DOCUMENTS

WO WO-2013162347 A2 * 10/2013 ..... B65D 19/0095
WO WO-2021091829 A1 * 5/2021 ..... C08G 63/183

* cited by examiner

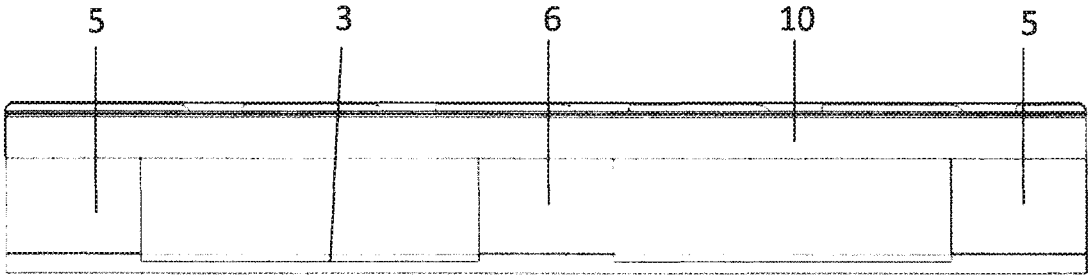
Figure 3
Figure 4
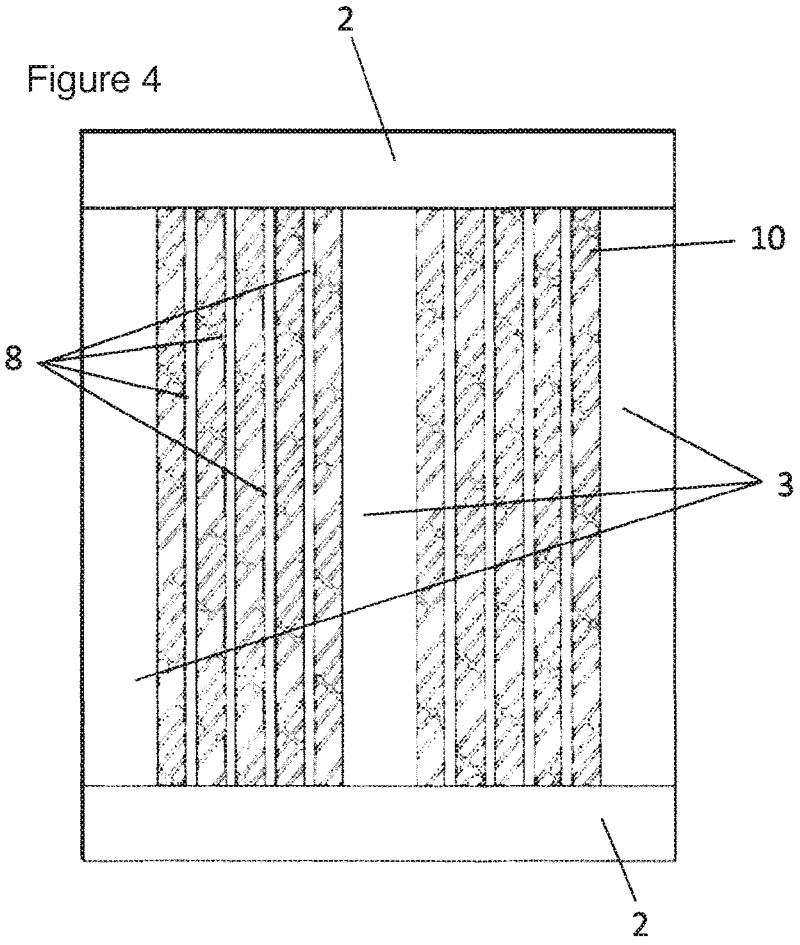

Figure 9
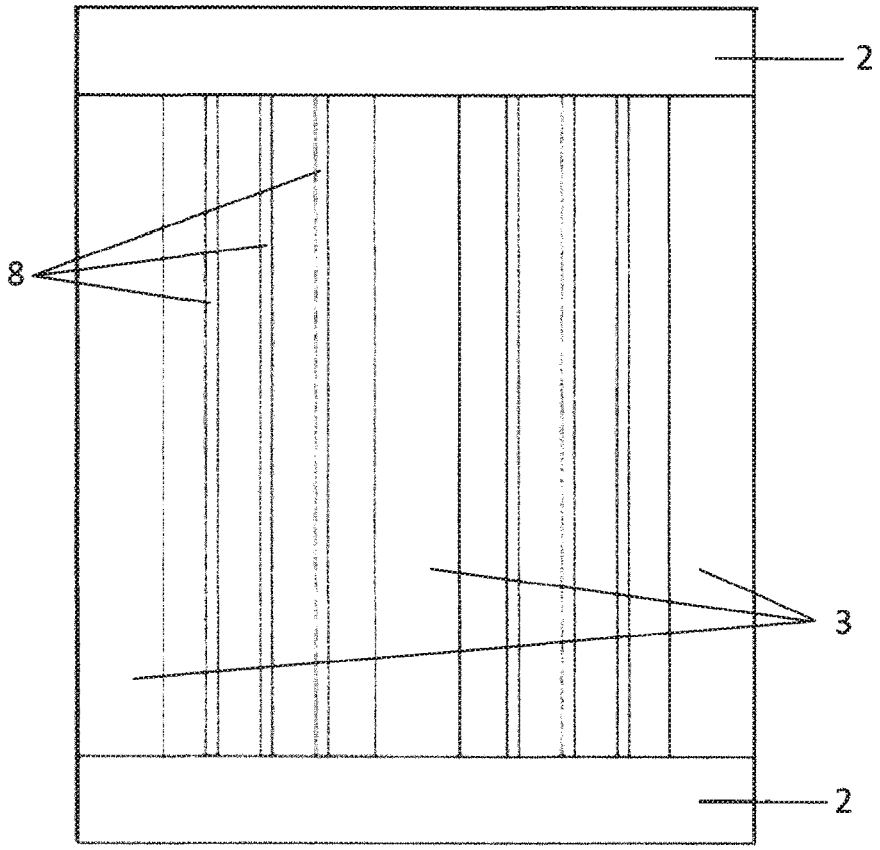
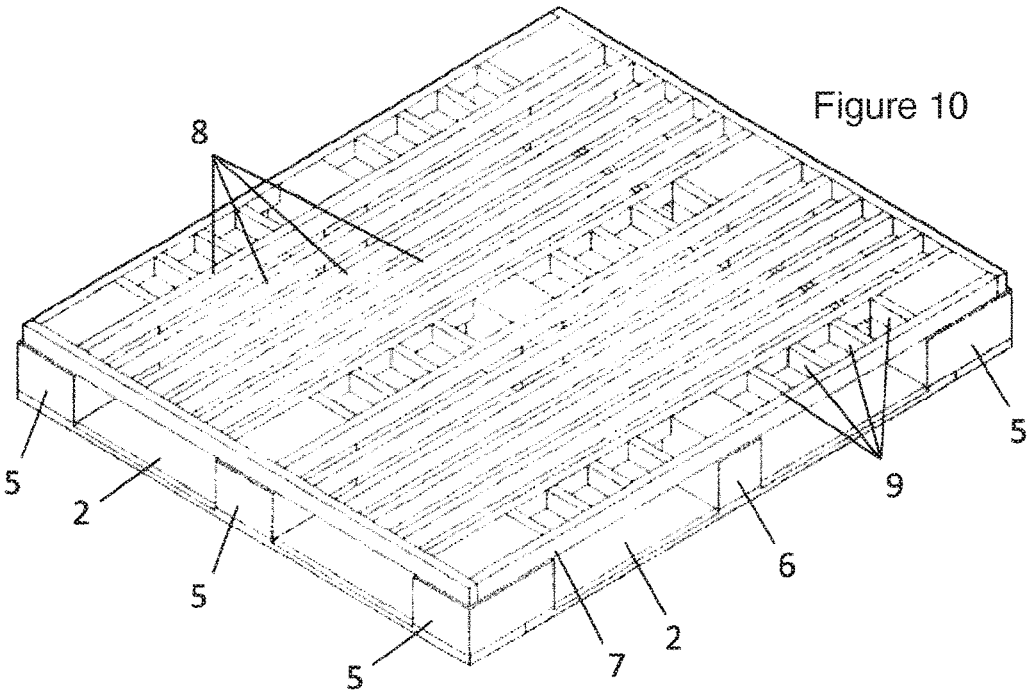
Figure 10

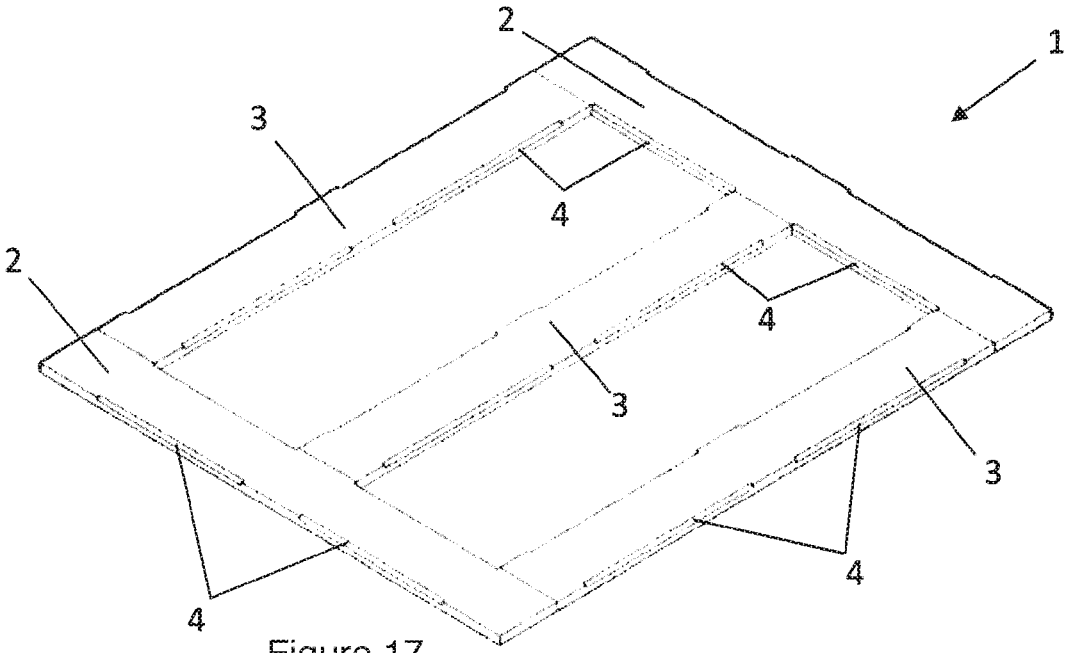
Figure 17
Figure 18
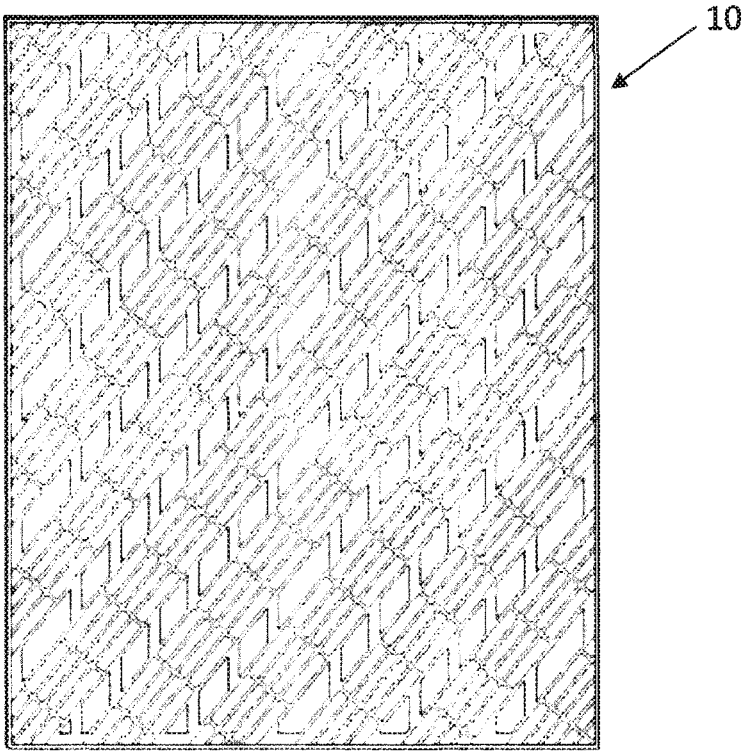

LOADING PALLET HAVING A SUPPORT FRAME AND INTERCHANGEABLE DECK

TECHNICAL FIELD OF THE INVENTION

The present invention relates to the technical field of pallets for loading and transportation, since it provides a pallet for loading with a frame support and interchangeable cover.

BACKGROUND OF THE INVENTION

Within the state of the art, pallets or platforms to transport goods are widely known elements since they are highly useful within the industry for the transport of infinity of products. Initially, these pallets have been made of wood, but with the passage of time and existing technological changes, the materials for the manufacture of pallets or platforms combine wood with highly resistant products, such as plastics or other elements. In the development of wooden pallets, the best known is the one that has longitudinal, flat members made of wood, which have a plurality of parallel spaced wooden cross members oriented at right angles in relation to the underlying flat, wooden pieces. Finally, in its lower part and between the longitudinal stringers, in its lateral and frontal parts, there must be a space for the entry of the nails of a forklift, this being the machinery usually used to transport the pallets or platforms. As evidenced, its generic configuration is very simple, which presents facilities for its manufacturing process.

Although most pallets are made of wood, there are also plastic, metal and paper. Each material has advantages and disadvantages in relation to the others.

The use of containers for transport and international trade has stimulated the use of pallets because transport containers have smooth surfaces necessary for the easy movement of loads. Today, more than 1.3 billion pallets are produced each year in the USA alone.

The pallets facilitate the transport of large volumes of goods since they can be easily moved by forklifts and even manually with hydraulic skids. In addition, it helps reduce the cost of handling and storage of materials. They allow an efficient, simple and fast loading and unloading process for palletized products.

They protect loads against breakage and damage. The load will always be arranged on a stable base. In addition, in the case of perishable products, these will always be above the ground, so they will be safe from moisture. For some time now, pallets have become the backbone of the logistics processes of companies. No material could leave a warehouse without them.

However, the lack of an international standard for the manufacture of pallets causes substantial expense in international trade, due to inefficient designs of the pallets and the poor arrangement of the merchandise on them. Damages occur to the products being transported, resulting in economic losses. In general, cargo operators do not carry out their maneuvers taking care of the pallets, since they consider that their work only consists of carrying out loading tasks, therefore, sometimes the transfer of the pallets is not adequate; the rush or lack of knowledge of the material can lead to blows or inappropriate transport. It is said that each year there are billions of dollars in losses due to merchandise damage caused by pallets. Three billion US dollars in 2012 in the United States of America alone.

Another problem that affects pallets during handling are forklifts or wheelbarrows. In some cases, due to the size and strength of the forklift nails, the operators, not handling them properly, hit the pallets, damaging them together with the merchandise. Another problem is when the weight of the load is poorly distributed and the wood can bend and end up breaking or, even worse, the pallet breaks and the load falls.

To solve the problems mentioned above, plastic pallets have been developed, manufactured from injected plastic, they are increasingly found in a greater number of warehouses, and they present certain advantages and disadvantages compared to those made of wood or other materials.

The first of its advantages is that plastic pallets weigh half, more or less, than one of the same characteristics made of wood. A second advantage is that they are more suitable for cleaning, something highly valued, especially in the food industry. In this sense, it must be taken into account that complex design plastic pallets require a mechanized and exhaustive cleaning, since they have many difficult-to-access corners where dirt accumulates very easily.

In addition, plastic pallets have a greater durability, ten times higher than wooden ones, since they suffer much less from the inevitable impacts that occur when handling. On the other hand, plastic pallets also have some drawbacks. For starters, they are more likely to deform under excessive load; also most of the time they are more expensive than the wooden ones.

Another disadvantage is that when these types of pallets are wet, there is a risk that they will slip on the forklift claws, on the dynamic racks and on the mobile racks, with the consequent risk of falling or traversing themselves. Finally, special care must be taken with its resistance. The type of plastic, the thicknesses used, the nerves used, the construction system of the mold and the injection, will influence its strength and rigidity.

The company CHEP TECHNOLOGY PTY LIMITED was in charge of designing a pallet called block, whose main characteristic is that it has four perimeter entrances, facilitating loading and unloading on any of its 4 sides, ensuring compatibility with all types of standard forklifts and pallet trucks, reduces product damage, provides greater efficiency in loading and unloading, provides greater storage security and is optimal for automated warehouses. The company obtained the Mexican patent MX 292292 (B) on Nov. 17, 2011, with the title "DURABLE TARIMA Y BLOQUE DE TARIMA", which describes systems and methods to join two or more pallet sections that include an upper deck and a background cover. The top deck may include a portion of decking blocks that protrude downward and include outer sleeves and protrusions or posts. The bottom deck may include an upwardly projecting portion of pallet blocks and includes inner liners, post pocket cavities, and radial ribs, wherein the post receiver grade is coupled to the inner sleeves by the plurality of radial ribs. The bracket may be inserted into the post pocket socket to project through the post support pocket and to extend beyond a plane that is defined by the bottom portions of the radial ribs. The top cover and bottom cover can be attached together using a heat staking assembly process that includes applying heat and pressure to deform a tip portion of the post to mechanically secure the top cover and bottom cover through the blocks.

A technical search for patents for cargo pallet with frame support and interchangeable cover was carried out, where it was found that different pallets have been developed for the same purpose, as mentioned in the publication of patent application number DE3806069 (A1), with Publication date of Apr. 29, 1999, entitled "PLASTICS PALLET", which describes a plastic pallet that has a platform with a stacking plate with resting elements under it. The stacking plate has several ventilation openings through it. The rest elements can be detached from the stacking plate. The stacking plate is rectangular and has regularly spaced sockets for the bolts for connecting the rest elements. There may be a regular pattern of threaded bushes on the stacking plate to fix the rest elements.

On the other hand, utility model number CN202464305 (U) was found, with publication date of Oct. 3, 2012, which has as title "PLASTIC TRAY OF COMBINED TYPE OF LARGE SIZE", which describes a plastic tray of Oversized combination type provided with a blister top cap, a folding plate and an blister pedestal. The vial top cap is attached to the vial pedestal through the folding plate and the top surface of the vial top cap is provided with at least two address identification bands. The large size combination type plastic tray is simple in technique and high in production efficiency. Conveniently, a large combo-type plastic tray can be installed. Since the address identification bands have the effects of attracting attention and warning an operator is enabled to accumulate large size combination type plastic trays embedded quickly and conveniently through paying attention to the address identification bands only to make sure that large combination type plastic trays are easily, firmly and stably stacked.

Finally, Mexican patent number MX 351950 (B), with publication date of Sep. 7, 1993, entitled "CARGO PALLET WITH FRAME SUPPORT", which describes a pallet for loading with a support element of the type frame. In its structure, the pallet has in its middle part a series of support elements parallel to the length of the pallet and two transverse ones, one at each end. It also has eight triangular supports, one in each corner and another four placed on the sides of the frame; at the bottom with elements perpendicular to the length; and in the upper part with a series of diagonal cross members, arranged in such a way that in combination with the frame they allow a considerable increase in the pallet's load capacity, without diminishing the maneuverability of a forklift.

As it can be seen in the first two documents, pallets that can have removable covers are described, however one of the main drawbacks is that removable covers are not designed so that said covers are easy to remove, nor is it evidenced that they solve the problem of efficiently transporting any type of cargo or product, be it boxes, sacks or buckets, it does not describe or reveal a configuration that makes the pallet rigid, avoiding damage to its structure and at the same time to the material that it is transported on said pallets.

On the other hand, the third document describes a pallet with a frame-type support element allowing the considerable increase in the pallet's load capacity, without diminishing the maneuverability of a forklift. However, it does not describe a pallet that can reinforce its rigidity, avoid damage in the impacts that occur from the sides, especially the damage caused to the columns of the pallets, as well as no evidence that it has a removable upper cover, nor is there evidence that it solves the problem of making efficiently transport any type of cargo or product, be it boxes, bags or buckets.

OBJECT OF THE INVENTION

It is, therefore, an object of the present invention to provide a pallet for loading with a frame support and an interchangeable cover, which solves the aforementioned problems.

BRIEF DESCRIPTION OF THE FIGURES

The characteristic details of this novel cargo pallet with frame support and interchangeable cover are clearly shown in the following description and in the accompanying figures, as well as an illustration thereof, and following the same reference signs to indicate the parts shown. However, these figures are shown by way of example and should not be considered as limiting for the present invention.

FIG. 3 shows a side view of the pallet for loading with frame support and interchangeable cover.

FIG. 4 shows a bottom view of the pallet for loading with frame support and interchangeable cover.

FIG. 9 shows a bottom view of the pallet for loading with frame support and interchangeable cover, without the upper cover.

FIG. 10 shows a top perspective view of the pallet for loading with frame support and interchangeable cover, without the top cover.

FIG. 17 shows a top perspective view of the platform of the loading pallet with frame support and interchangeable cover.

FIG. 18 shows a bottom view of the upper deck of the pallet for loading with frame support and interchangeable cover.

DETAILED DESCRIPTION OF THE INVENTION

Figure 16:
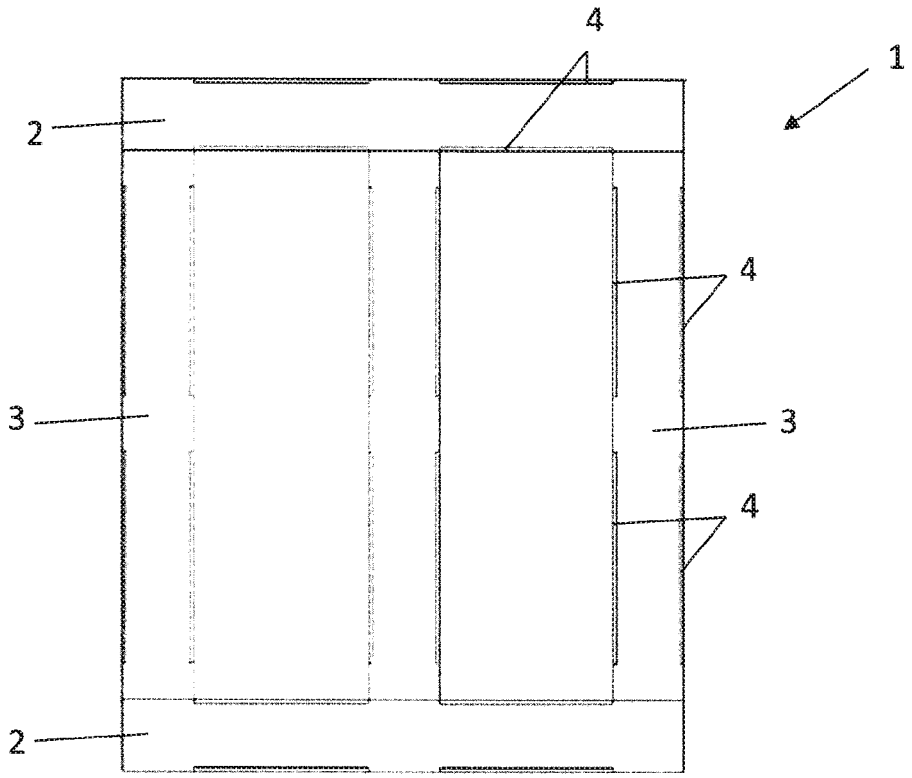
FIG. 16 shows a top view of the platform of the pallet for loading with frame support and interchangeable cover.
Figure 19:
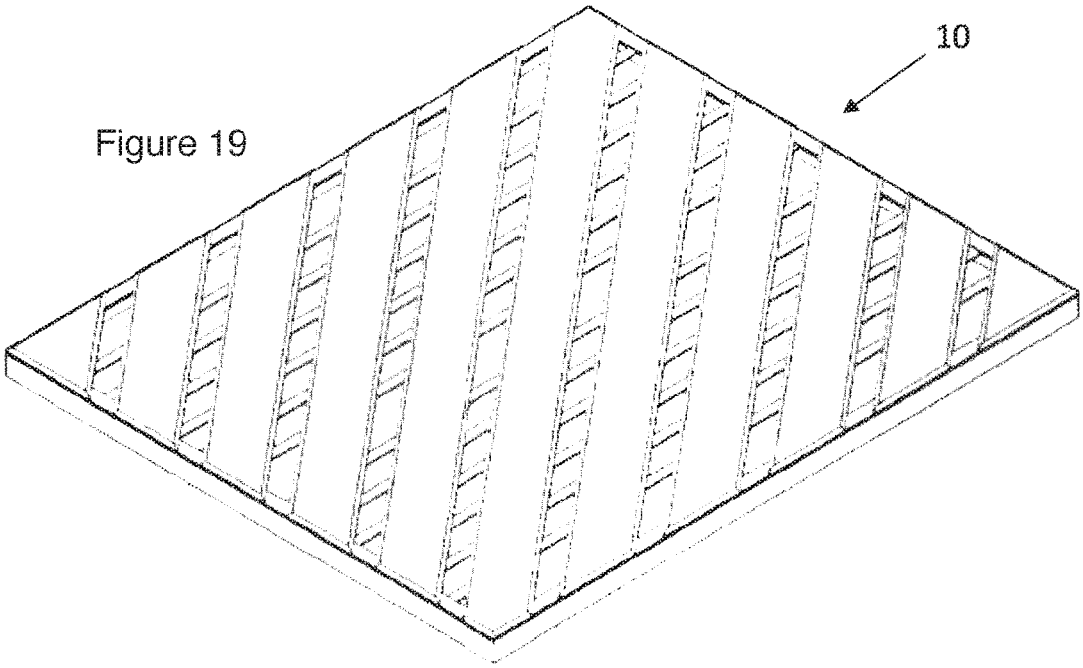
FIG. 19 shows a top perspective view of the upper deck of the pallet for loading with frame support and interchangeable cover.
Figure 20:
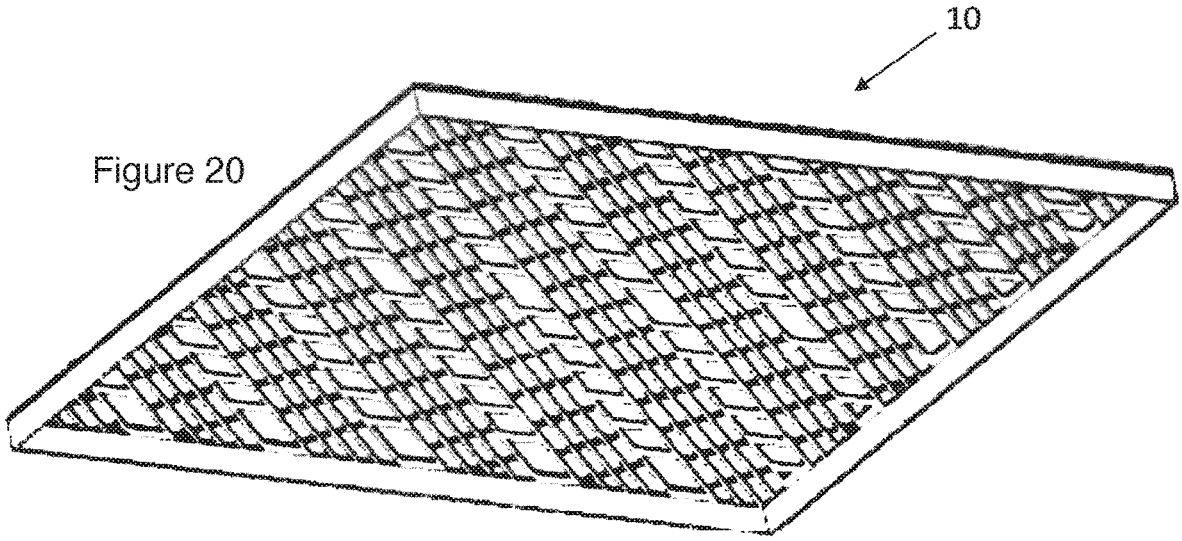
FIG. 20 shows a bottom perspective view of the upper deck of the pallet for loading with frame support and interchangeable cover.

For a better understanding of the invention, the parts that make up the pallet for cargo with frame support and interchangeable cover are listed below:

1. Platform
2. Cross member
3. Stringer
4. Bevel
5. Main block
6. Secondary block
7. Frame
8. Bars
9. Barrier
10. Top cover
11. Tab With reference to the figures, the pallet for loading with frame support and interchangeable cover is made up of a platform (1) made up of two cross members (2) and three stringers (3), which together form a parallelogram, preferably a square or rectangle, as illustrated in FIGS. 16 and 17, both the cross members (2) and the stringers (3) have at least one bevel (4) on each longitudinal edge of the front part, which allows to facilitate that the tires of a forklift, trolley or any equipment to hold and move the pallet for loading with frame support and interchangeable cover, can be inserted in a simple way from all four sides and without causing damage to the cross members (2) and the stringers (3).

Figure 13:
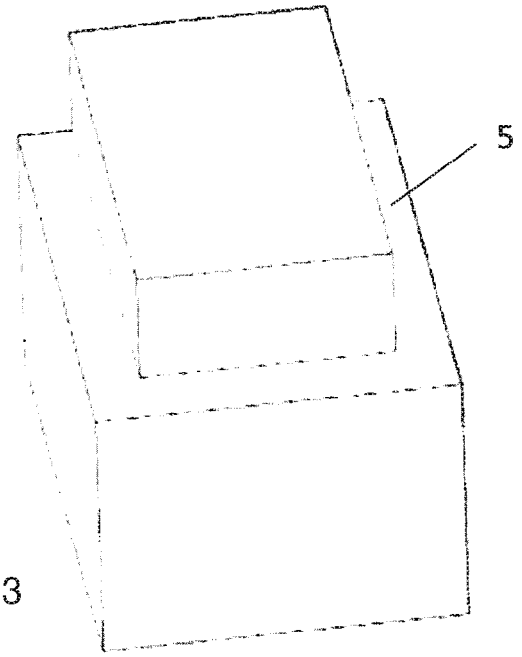
FIG. 13 shows a front perspective detail view of the corner block of the pallet for loading with frame support and interchangeable cover.
Figure 14:
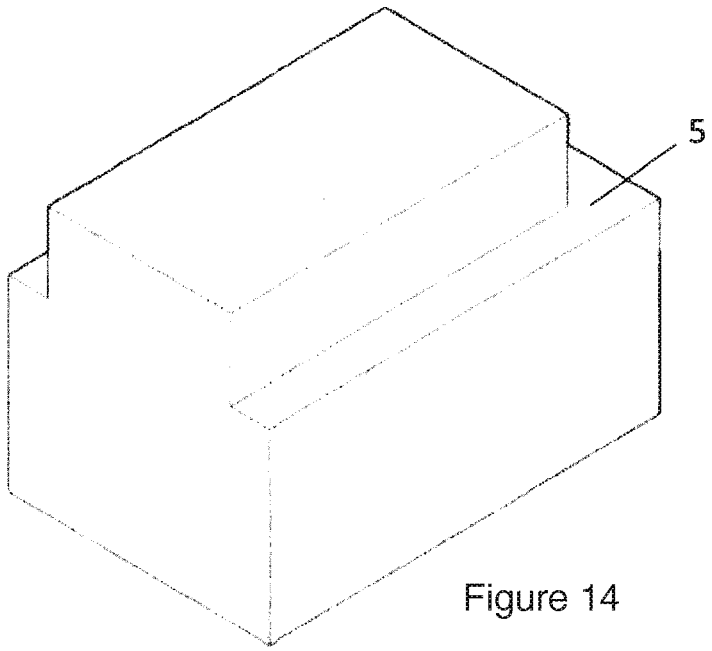
FIG. 14 shows a rear perspective detail view of the corner block of the pallet for loading with frame support and interchangeable cover.
Figure 21:
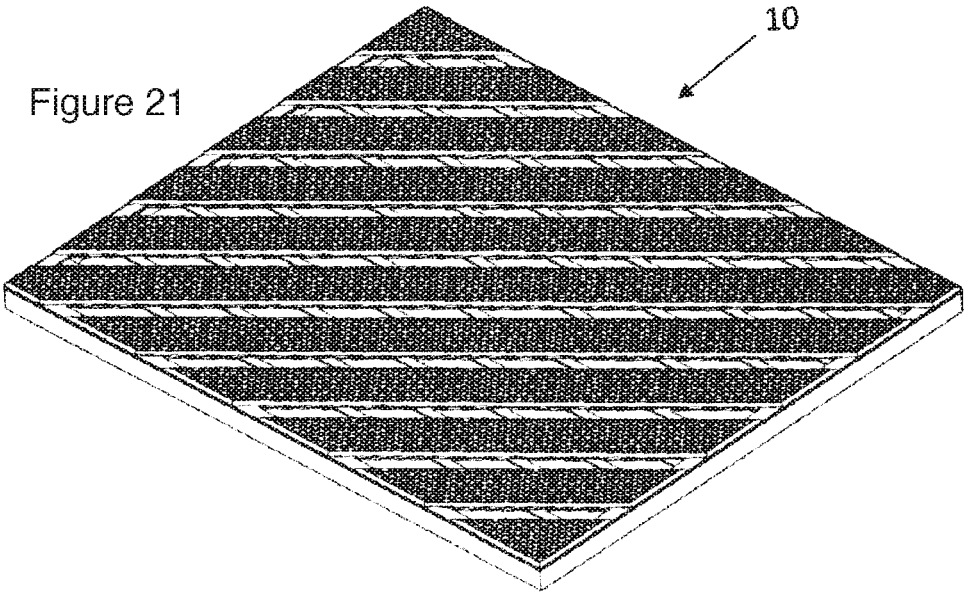
FIG. 21 shows a top perspective view of the upper cover with non-slip material, of the pallet for loading with frame support and interchangeable cover.

With reference to FIG. 21, at least three main blocks (5) are fixed on each crossbar (2) distributed one on each edge and one in the center, being aligned and on top of each stringer_(3). Each main block (5) is prismatic in shape, preferably rectangular and has a second prism of smaller proportion at its upper base, allowing at least three supports on the upper base, as can be seen in FIGS. 13 and 14.

Figure 15:
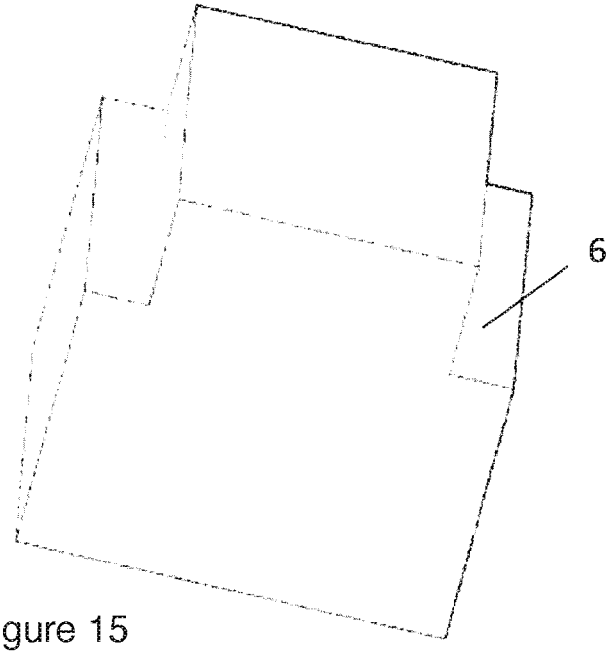
FIG. 15 shows a detailed perspective view of the central block of the pallet for loading with frame support and interchangeable cover.

With reference to FIG. 21, at least one secondary block (6) is attached to the center of each stringer (3). Each secondary block (6) is prismatic in shape, preferably rectangular and has a second prism of smaller proportion at its upper base, allowing at least two supports on the upper base, as shown in FIG. 15.

Figure 1:
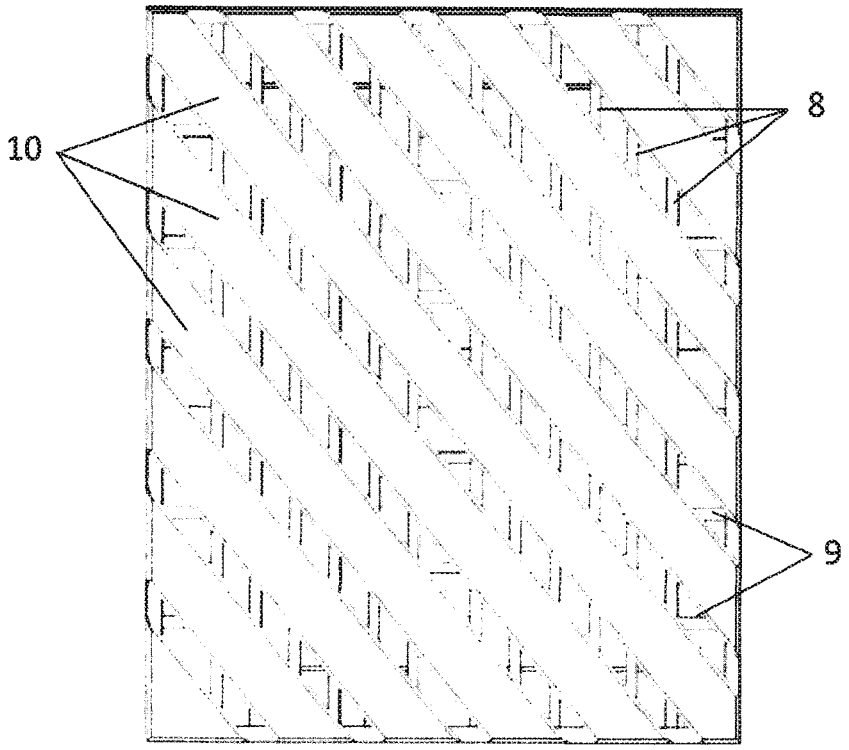
FIG. 1 shows a top view of the pallet for loading with frame support and interchangeable cover.
Figure 2:
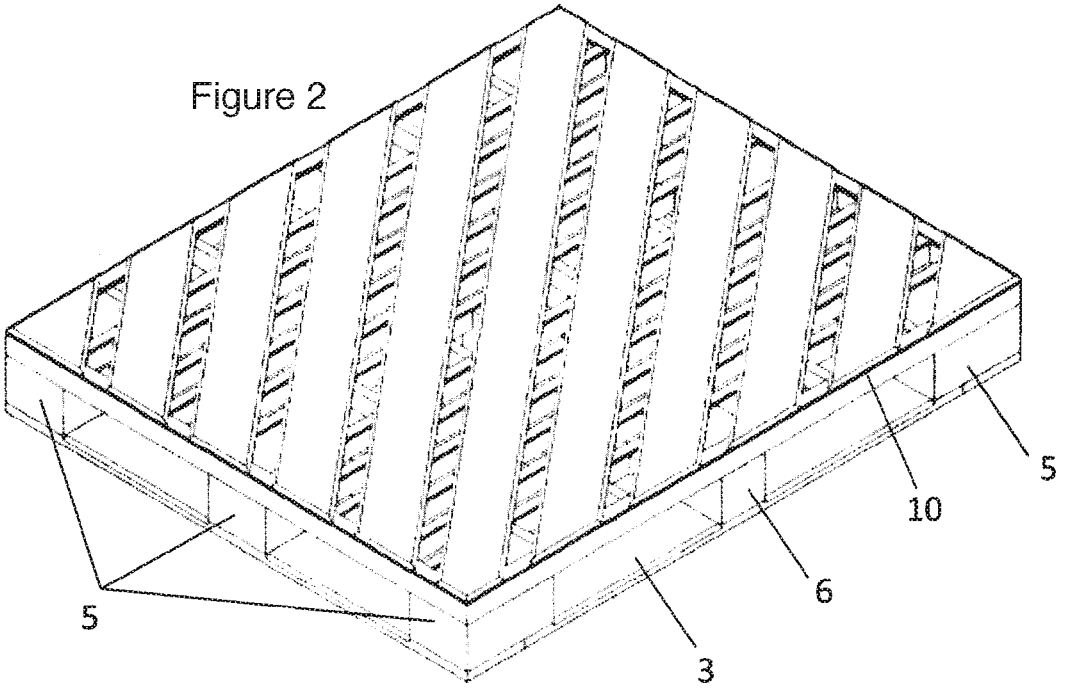
FIG. 2 shows a top perspective view of the pallet for loading with frame support and interchangeable cover.
Figure 5:
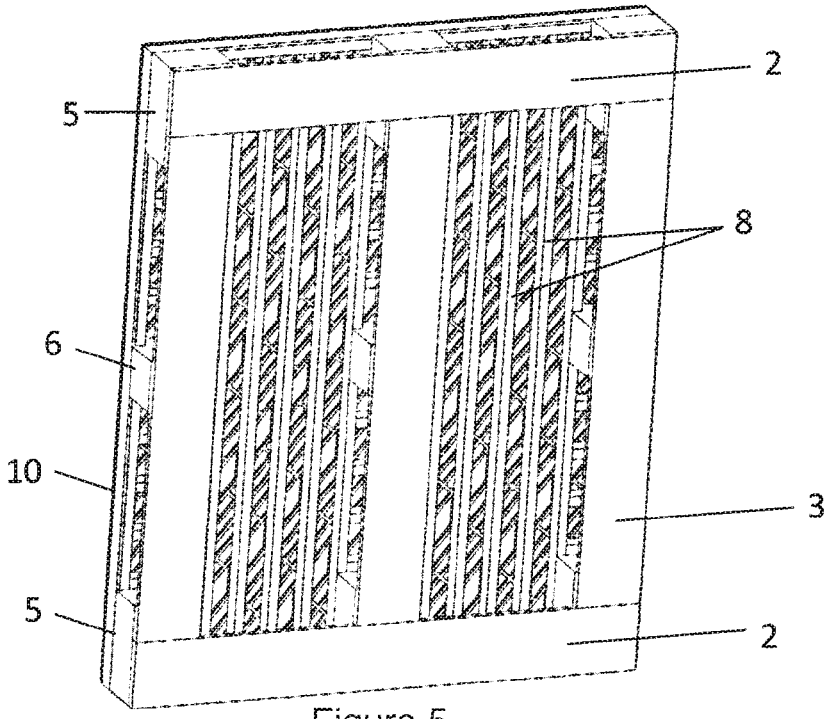
FIG. 5 shows a bottom perspective view of the pallet for loading with frame support and interchangeable cover.
Figure 6:
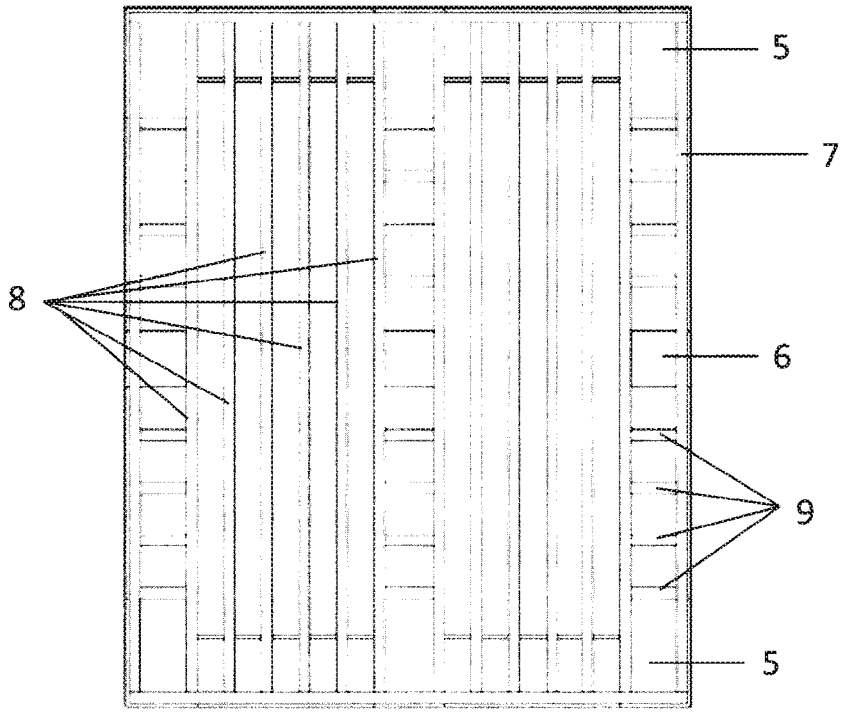
FIG. 6 shows a rear view of the pallet for loading with frame support and interchangeable cover, without the upper cover.
Figure 7:
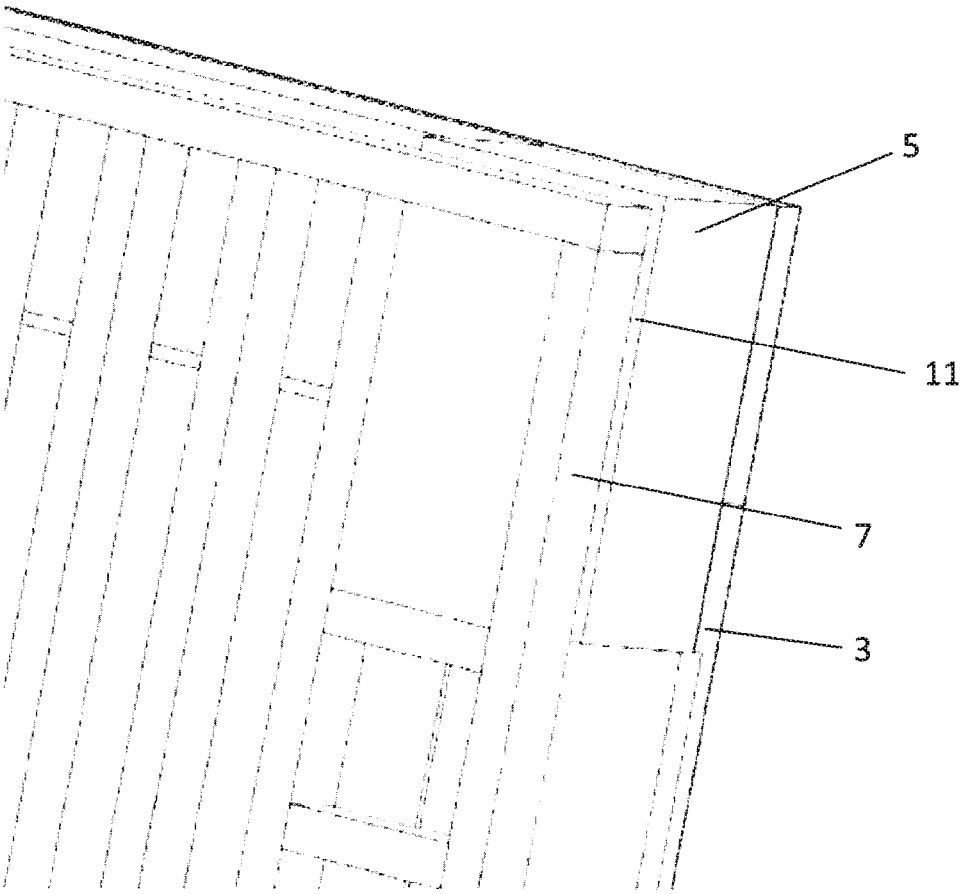
FIG. 7 shows a detailed view of the flange generated by the extraction of the corner block from the pallet for loading with frame support and interchangeable cover.
Figure 8:
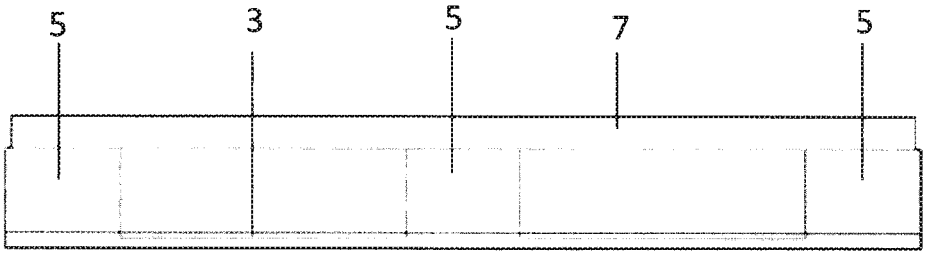
FIG. 8 shows a side view of the pallet for loading with frame support and interchangeable cover, without the upper cover.
Figure 11:
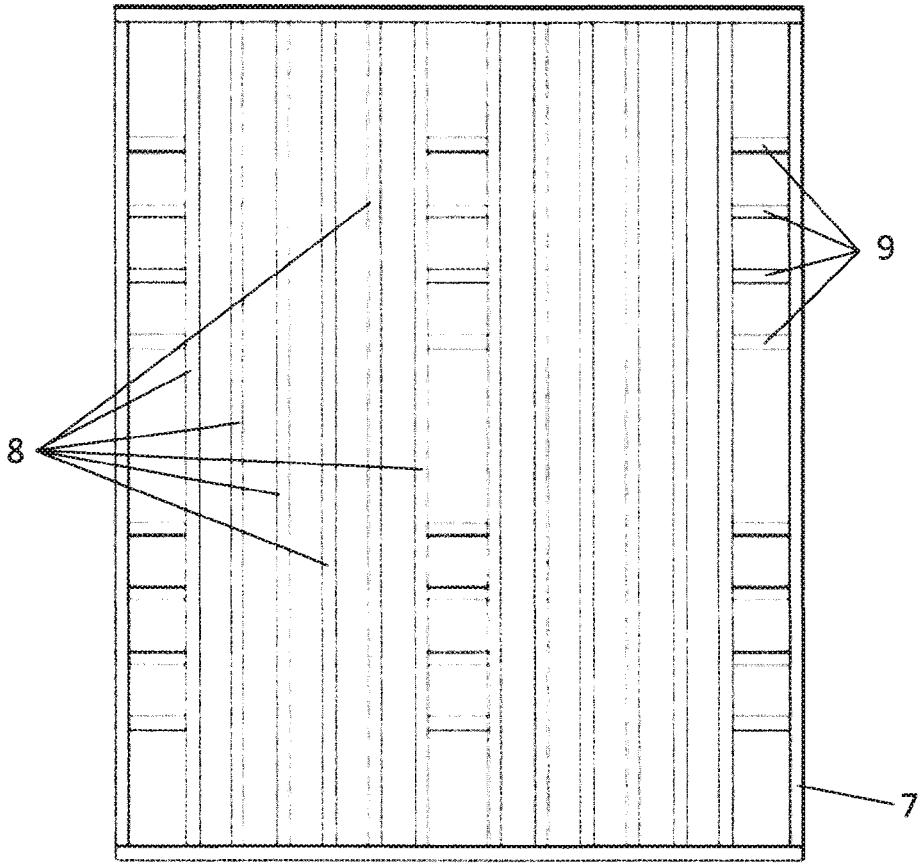
FIG. 11 shows a top view of the frame of the pallet for loading with frame support and interchangeable cover.
Figure 12:
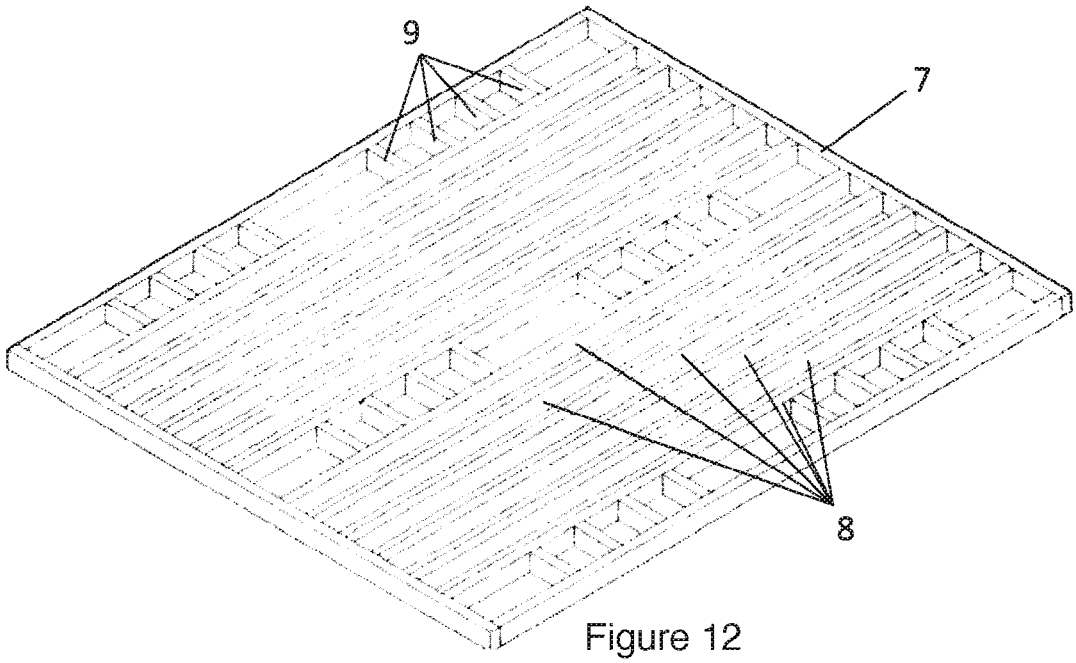
FIG. 12 shows a top perspective view of the frame of the pallet for loading with frame support and interchangeable cover.

As shown in FIG. 10, the frame of a frame (7) is placed on the external supports formed in the main block (5) and secondary block (6), allowing a flange (11) to form in the contour of said blocks, as illustrated in FIG. 7. The frame (7) is made up of a plurality of bars (8) placed inside the frame of said frame (7) which has holes (not illustrated) for its fixing, by means of fastening (not illustrated), which can be screws, nails, rivets, tongue and groove systems and/or a combination of the above.

At least four bars (8) rest on the internal supports formed in the main block (5) and secondary block (6), thereby allowing the pallet for load with frame support and interchangeable cover to have greater rigidity and support.

With reference to FIGS. 6, 10, 11 and 12, a plurality of barriers (9) are placed between the bars (8), of which at least one barrier (9) is placed next to each main block (5), giving greater rigidity to said block and preventing it from turning or moving when it is hit with a forklift claw, thus avoiding damage to the pallet for loading with frame support and interchangeable cover when it is being handled.

When the main block (5) and secondary block (6) are made of wood, the grain of the wood is placed vertically, in order to have greater support or resistance to the impacts presented by the forklift nails.

Figure 22:
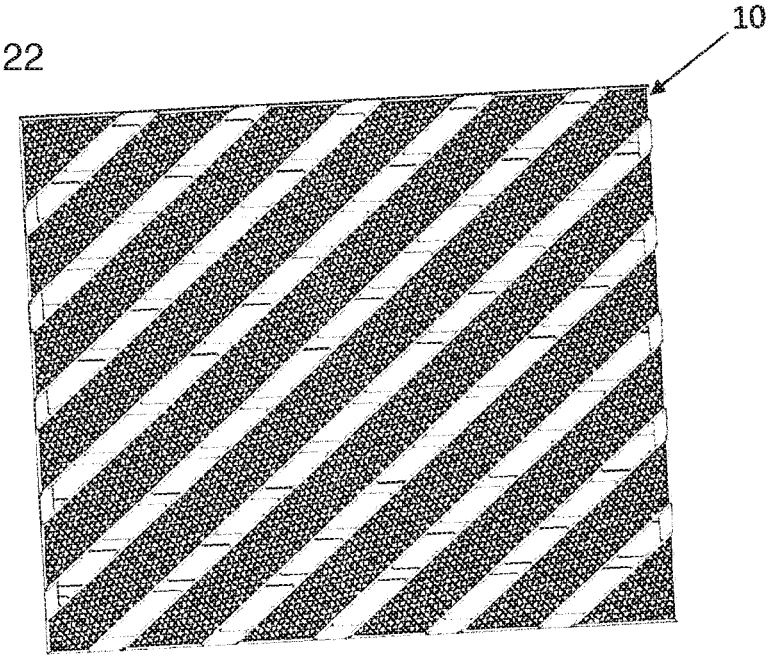
FIG. 22 shows a top view of the upper cover with non-slip material, of the pallet for loading with frame support and interchangeable cover.
Figure 23:
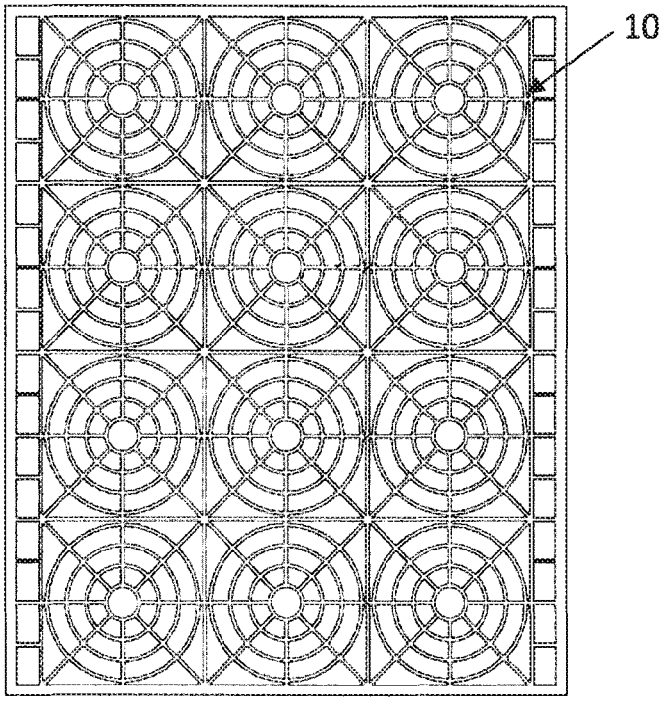
FIG. 23 shows a top view of the upper cover with circular reliefs to place buckets, of the pallet for loading with frame support and interchangeable cover.
Figure 24:
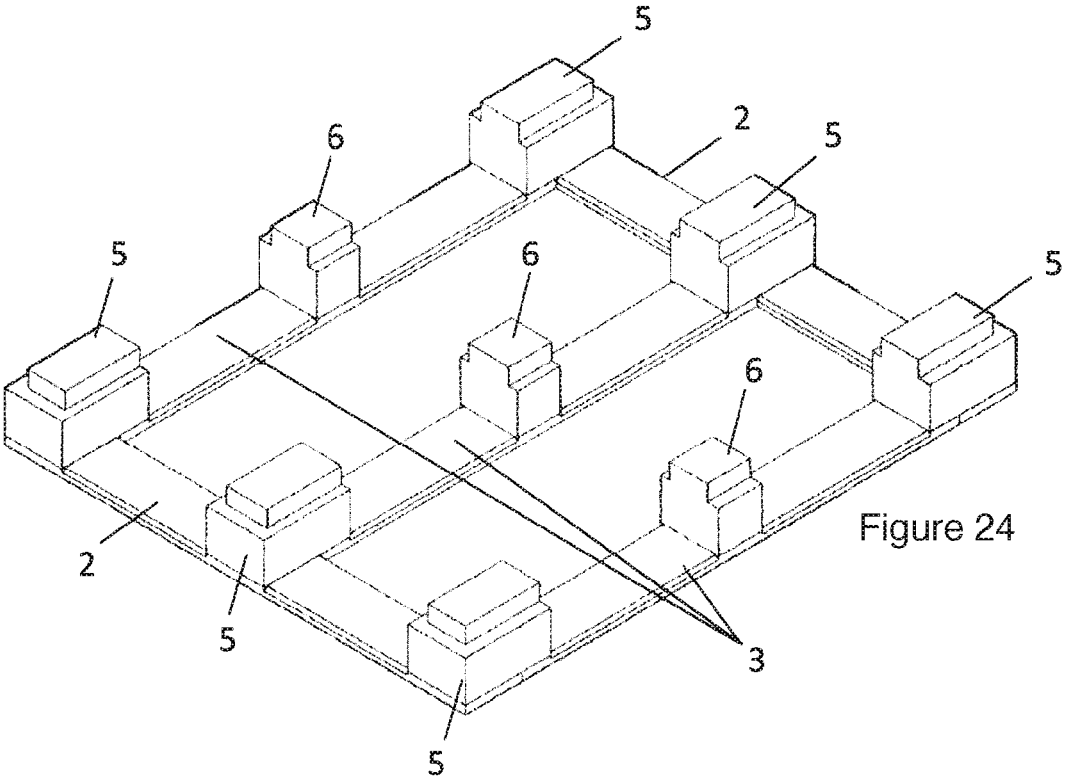
FIG. 24 shows a perspective view of the arrangement of the main blocks and secondary blocks on the frame of the pallet for loading with frame support and interchangeable cover.

An upper cover (10) is placed covering the frame (7), supporting and securing itself on the flange (11) in a quick and easy way, without the need to use specialized tools. The surface of the upper cover (10) can be of varied shapes and designs, for example, inclined crossbars, with circular reliefs to place buckets and that these do not move, as illustrated in FIG. 23. The upper cover (10) it can have reliefs in the shape of parallelograms, to place boxes of different sizes and/or a combination of the above; Another characteristic of the upper cover (10) is that its surface can have a non-slip, non-slip material, as shown in FIGS. 21 and 22, this in order to increase its coefficient of friction, allowing to ensure that the material that is placed on the pallet for loading with frame support and interchangeable cover, do not move during transport.

The configuration described above allows the pallet for load with frame support and interchangeable cover, not to have a deflection caused by the load it is supporting.

Tests

The company White & Company LLC, specialized in the design of Unit Load, carried out several tests on the pallet for load with frame support and interchangeable cover.

All testing was conducted at the ISTA-certified Center for Unit Load Packaging and Design (CULD) in Blacksburg, Va., United States of America.

All tests follow ISO 8611. "Material Handling Pallets—Flat Pallets—Parts 1, 2 and 3, other than ASTM D 1185-98a section 9.5" Vibration tests on loaded pallets "and the simulation of storage and handling of dynamic warehouses As well as the ASTM D 1086 standard referring to FAST TRAK (Fast Track) of a pallet evaluation.

Coefficient of Friction (COF) Test

The COF at the interface between a 6.8 Kg corrugated cardboard box and a 9.1 Kg returnable plastic container (RPC) was tested by pulling them across the pallet boards with a force gauge. Therefore, the interchangeable deck and frame support cargo pallet was placed on standard industrial clevis teeth, directly under the pallet stringers (3) and dragged across the pallet with the force gauge. All tests were done to measure friction between the object and the surface. Three repeated tests were performed in both orientations. Each test replicates the completed task.

It is important to mention that the COF of a conventional wooden pallet is 0.3 for the pallet packaging interfaces and 0.2 for the pallet to fork interfaces.

The pallet for cargo with frame support and interchangeable cover showed that the COF of the same interfaces varies from 0.72 to 0.89, which indicates an increase in surface friction with the current configuration.

Conclusions: The design and configuration of the freight pallets with interchangeable cover and frame support provide excellent surface friction at the fork and pack teeth interfaces for stable movement and delivery of unit loads.

Falling the Corner

Freight pallets with frame support and interchangeable cover were taken and tested to determine the diagonal stiffness and resistance to damage when each pallet is dropped into the same corner under vacuum. Each deck was dropped 10 times at a distance of 102 cm and 10 more times at 204 cm or to failure. A winch system was used to raise and release the pallet for each fall. Diagonal measurements were made on both sides of the pallet after each fall to record deformation.

Based on average cumulative kinetic energy in the event of failure, on average the freight skid with frame support and interchangeable cover resisted more than 2.5 times damage when dropped under vacuum compared to other pallets tested.

Conclusions: The pallet for cargo with frame support and interchangeable cover, is 2.9 times more resistant to damage during empty handling than conventional ones.

Inclined Impact

The inclined impact test apparatus includes a rolling cart measuring 122 centimeters×122 centimeters (48 inches×48 inches), attached to a rail set at a 10 degree angle to the level concrete floor. The impact surface contains a fully adjustable fork lateral derailleur with two fork teeth which meet ISO 8611 specifications. A series of four different inclined impact tests were carried out, each with a load-bearing pallet. Interchangeable frame and cover positioned for end plate, side plate, terminal block and side block impact. Three samples of pallets were tested for each of the four different test orientations. Each test began with 10 impact cycles 30 mm (12 in) from the heel of the fork teeth for end and side impacts and 15 cm (6 in) from the tip of a tooth for end impacts and 114 kg side blocks (250 pounds) load. Once these cycles were completed, an additional 205 kg was added to the load and 10 more impact cycles were performed. With the remaining load, the impact distance was increased by 30 mm (12 inches) after completing each cycle of 10 impacts until the pallet sample failed or 10 impacts were achieved at 122 cm. (48 inches).

The average cumulative kinetic energy of the pallet top end for load with frame support and interchangeable cover and the side at the capacity of the machine was 93 kjoules. The excellent resistance to impact of the pallet is a direct result of the reinforcement of the beams provided by the barriers (9). The top deck is predicted to be weaker than the ends, although the top deck side boards are reinforced with small barriers (9), significantly enhancing the 12.19 cm (48 in) side impact durability. Based on these results, the freight pallet with frame support and interchangeable cover was at least 5% stronger at the ends than the rest and 2.3 times stronger at the sides.

Conclusions: The freight pallet with frame support and interchangeable cover is 2.5 times more resistant to side impacts on the upper platform during unit load handling. The deck is 63 times more resistant to end block impacts and 24 times more resistant to side impacts than the Eco deck.

Static Strength and Rigidity

This test is based on ISO 8611 Section 8, Tests 2, 4, 5 and 7 "Bending tests".

Static flex tests were performed with 18,200 kg (40,000 pounds) on a Tinius-Olsen mechanical compression testing machine. The air bag loading applicator was used to determine the strength, stiffness and resistance in working load for the pallet for load with frame support and interchangeable cover. The test used 12.7-centimeter (5-inch) potentiometers to measure the deformation of the pallet.

The support test conditions were as follows:

- Across the length (RAL) 112 centimeters (44 inches) of clearance. The support beams were 4 inches (10 cm) wide.
- Across the width (RAVV) of 91 centimeters (36 inches) of free space. The support beams were 10 centimeters (4 inches) wide.
- On the upper deck (FSTD). The support beams were 10 centimeters (4 inches) wide.
- Lower platform (FSBD). The support beams were 10 centimeters (4 inches) wide.
- Forklift claws parallel to pallet length (FTPA). The support beams were 10 centimeters (4 inches) wide.
- Forklift nails perpendicular to pallet length (FTPA). The support beams were 10 centimeters (4 inches) wide.

Three replicate endurance tests were performed on load pallets with frame support and interchangeable cover, using each of the four support conditions indicated above. Deflection measurements were made using string potentiometers at two specific locations for each test as follows:

- RAL=below the center block and on the side of both 102 centimeter (40 inch) center end blocks.
- RAW=under the center block and on the side of both 122 centimeter (48 inch) center side blocks.
- FSTD=below two adjacent panels in the center of the studs (between the blocks) and on the edge of an outer board of the studs (between the blocks).
- FSBD=the center of a bottom end board and the edge of the center bottom board with the butt and the bottom board with one side of the board.
- FTPA=below the center block and on the side of two adjacent corner blocks and both center side blocks.
- FTPE=under the center block and on the side of two adjacent corner blocks and both center side blocks.

10,886 kilograms (24,000 lb) air bag load applicator capacity or failure resistance tests were conducted.

The creep test was replicated for each support condition indicated above. Each creep test was computer controlled. A specific test load was applied and the load is held for two hours (30 minutes for forklift claw conditions). For a successful creep test, the strain rate must be static or decreasing. The proof load cannot exceed ½ of the average load in case of failure. The load was then reduced to 9 Kg (20 pounds) for one hour to measure the amount of recovery from deformation. Permanent deformation should not exceed 0.75% of the shelf span. For stacking, permanent deformation cannot exceed 0.53% of the span. Deflection measurements were made at the same locations indicated above.

Findings: The maximum safe working load capacity of the length of the interchangeable cover rack-mount cargo pallet spanning storage shelves is 3,175 kilograms (7,000 pounds). The maximum deflection in two hours was 1.70 centimeters (0.67 inches).

The maximum safe working load capacity of the pallet width for load-bearing frame and interchangeable cover spanning in storage shelves is 2,359 kilograms (5,200 pounds). The maximum deflection in two hours was 1.70 centimeters (0.67 inches).

When stacking load pallets with frame support and interchangeable cover the maximum safe load is 5,443 Kilograms (12,000 pounds). The maximum deflection in two hours was 0.60 centimeters (0.24 inches).

Interchangeable deck and frame support pallet did not fail at a machine capacity of 10,886 kilograms (24,000 lbs.)

Fastrack Warehouse Storage and Handling Simulation

The protocol developed and used in the Virginia Tech Pallet and Container Research Laboratory, based on the ASTM D1083 standard, recommends the rough and simulated handling of palletized unit loads to evaluate the structural durability and determine the economy of use of the pallet. pallet for loading with frame support and interchangeable cover. This can be achieved by rough and accelerated handling using devices used in material handling.

The modification made by Virginia Tech is based on the test protocol developed by the Procter and Gamble Company to simulate the use of pallets in the grocery products industries.

The test simulates idle pallet storage, palletizing, shipping, transportation, receiving, and three types of storage: static rack, flow rack, and block stakeout. Handling devices used in the FasTrack include a 1,363 Kilogram (3,000 pound) balanced counterweight capacity and a 1,818 Kilogram (4,000 pound) capacity electric jack. Forklift operating speeds are 1.6 Km/Hr (1 mph) and 4.8 Km/hr (3 mph), depending on the driving mode. The operating speed of the electric jack is 3.2 Km/hr (2 mph). A dummy load of 682 kg (1500 lbs) is typically used. However, on request, other load levels are possible. This test is carried out with 10 pallets and 10 have to be done 10 cycles for each pallet.

Conclusions: The performance of the pallet for cargo with frame support and interchangeable cover, in this test was outstanding, for which the company White & Company LLC. made the decision to modify the conditions of the test, from 10 pallets reduced to 5 pallets for the test and increased the number of cycles from 10 to 20, to put each pallet to a greater test and even so, the pallet for load with frame support and interchangeable cover was not damaged.

As can be seen, the configuration of the cargo pallet with frame support and interchangeable cover, reason for the present invention, provides several benefits for its performance in the different tests carried out.

The invention has been sufficiently described so that a person of ordinary skill in the art can reproduce and obtain the results that we mention in the present invention. However, any person skilled in the field of the art that is concerned with the present invention may be able to make modifications not described in the present application, however, if for the application of these modifications in a certain structure or in the manufacturing process of this, the matter claimed in the following claims is required, said structures should be understood within the scope of the invention.

The invention claimed is:

1. A pallet with frame support and an interchangeable cover comprising a platform (1) made up of two crossbars (2) and three stringers (3), which together form a parallelogram;

Both the cross members (2) and the stringers (3) have a front part comprising a longitudinal edge with at least one bevel (4);

the pallet further comprises three main blocks (5), each of which comprises a lower base and an upper base;

said main blocks (5) are fixed on each crossbar (2) distributed one on each said longitudinal edge and one in the center, such that each main block is aligned with, and on top of a corresponding stringer (3), each main block (5) is prismatic in shape, each main block (5) further comprises a second prism of smaller proportion located along said upper base of the main block allowing at least three supports on the upper base;

the pallet further comprises at least one secondary block (6) fixed to the center of each stringer (3), each said secondary block comprises an upper base, each said secondary block (6) is prismatic in shape, each said secondary block (6) further comprises a second prism of smaller proportion located along said upper base of the secondary block (6) allowing to have, at least, two supports on the upper base;

said pallet further comprises a frame (7) having a perimeter and a plurality of bars (8) within said perimeter;

the frame (7) is positioned over the main blocks (5) and secondary blocks (6), forming a flange (11) in the contour of said main blocks and said secondary blocks;

at least four said bars (8) are positioned on the main block (5) and secondary block (6);

a plurality of barriers (9) are between the bars (8);

said interchangeable cover (10) adapted to fit over the frame (7) within said flange (11).

* * * * *